United States Patent [19]

Miller et al.

[11] 4,062,282

[45] Dec. 13, 1977

[54] REFUSE COMPACTOR

[75] Inventors: Samuel Jacob Miller, Junction City; Erwin George Smith, Danville, both of Ky.

[73] Assignee: Whirlpool Corporation, Benton Harbor, Mich.

[21] Appl. No.: 717,367

[22] Filed: Aug. 24, 1976

[51] Int. Cl.[2] ..... B30B 15/14

[52] U.S. Cl. ..... 100/53; 100/229 A; 100/295

[58] Field of Search ..... 100/52, 53, 295, 229 A; 53/124 B; 141/71, 73, 80

[56] References Cited

U.S. PATENT DOCUMENTS

| | | | |
|---|---|---|---|
| 3,805,084 | 4/1974 | Schuerman | 100/52 |
| 3,807,295 | 4/1974 | Engebretsen | 100/53 |
| 3,808,453 | 4/1974 | Engebretsen | 100/52 |
| 3,842,729 | 10/1974 | Mandrup | 100/229 A |
| 3,861,296 | 1/1975 | Clar | 100/53 |
| 3,882,771 | 5/1975 | Frohbieter | 100/53 |
| 3,994,216 | 11/1976 | Difley | 100/53 |

*Primary Examiner*—Billy J. Wilhite

*Attorney, Agent, or Firm*—Wegner, Stellman, McCord, Wiles & Wood

[57] ABSTRACT

A refuse compactor having structure for preventing displacement of the compactor receptacle beyond a preselected permissible displacement during the compacting operation. The control includes a tilt switch for terminating operation of the compacting ram in the event of a preselected tilt movement of the receptacle during the compacting operation. The control further includes a safety switch preventing operation of the ram when the receptacle is displaced beyond a preselected distance from the compacting position. The displacement limiting structure disclosed herein is carried by the ram so as to be operative during the compacting operation to prevent a movement of the receptacle substantially beyond that effecting an opening of the tilt switch. The ram may be provided with a wiper which may form a portion of the displacement limiting structure.

11 Claims, 5 Drawing Figures

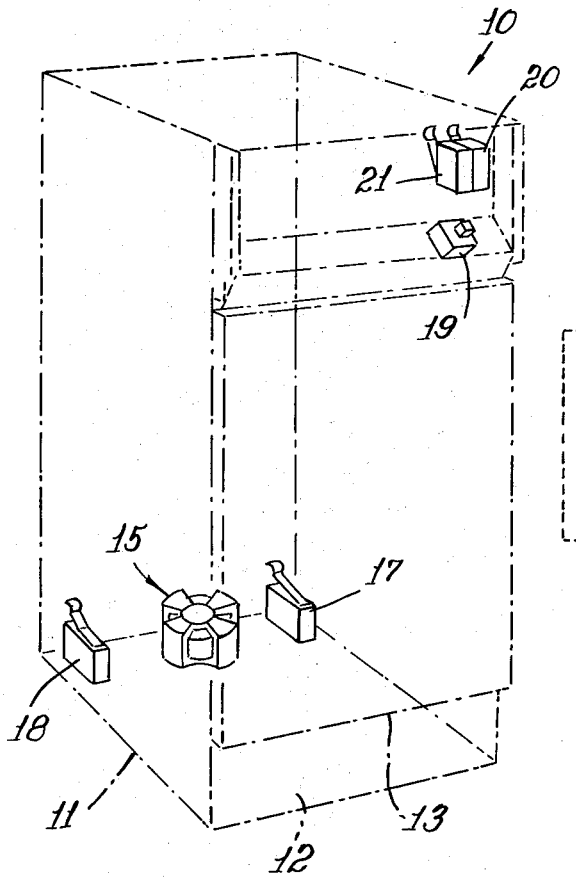
Fig. 1
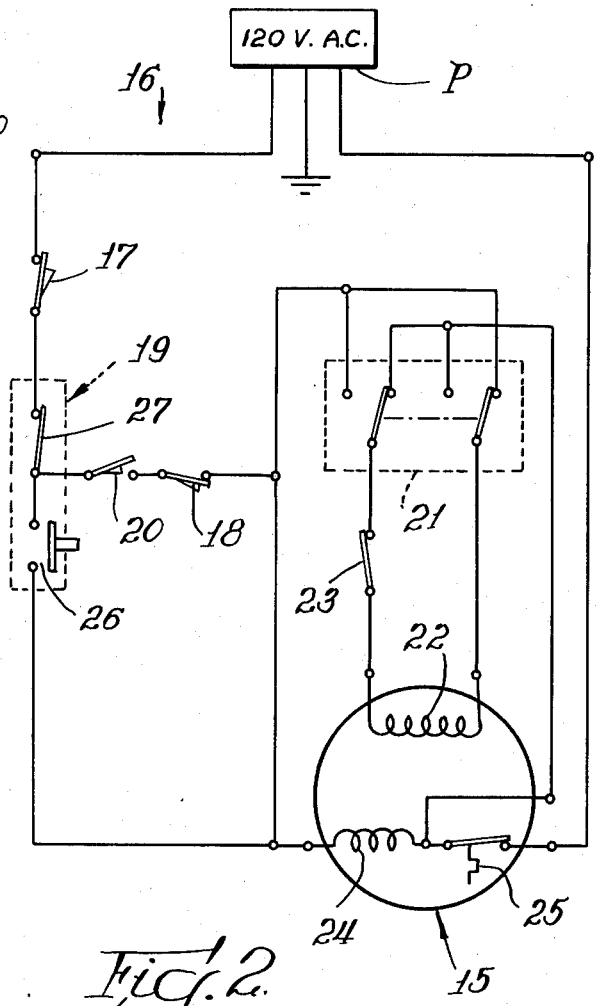
Fig. 2
Fig. 4
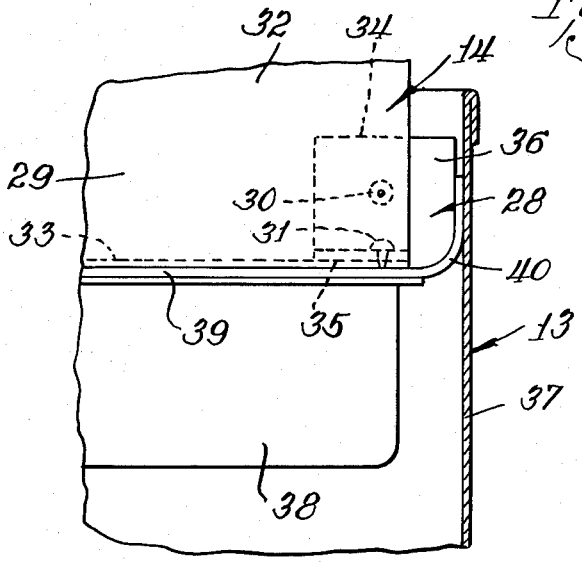

REFUSE COMPACTOR

BACKGROUND OF THE INVENTION

1. Field of the Invention

This invention relates to refuse compactors and in particular to control means for use therein for preventing undesirable malfunctioning or undesirable functioning of the compactor.

2. Description of the Prior Art

In the U.S. Pat. No 3,613,560 of Michael J. Bottas et al., which patent is owned by the assignee hereof, a refuse compactor is disclosed having a receptacle safety switch which is arranged to be closed only when the receptacle is substantially in the fully closed position, thereby preventing undesirable operation of the ram whenever the receptacle is not in proper compacting position within the cabinet.

In copending U.S. patent application Ser. No 597,405 of Charles R. Difley et al., now U.S. Pat. No. 3,994,216 which application is owned by the assignee hereof, a refuse compactor control is disclosed having a plurality of switches and structure for actuating the switches under different conditions, including a tilted condition and a displacement of the receptacle from the compacting position generally similar to the displacement switch of the Bottas et al. patent discussed above. In the Difley et al. patent, the switches are juxtaposed for operation by an acutator having a plurality of different operating portions for acutating the different switches under different conditions of the compactor.

In the event that the receptacle is tilted as by an uneven distribution of refuse in the receptacle, causing the ram to wedge or force the receptacle angularly during the compacting operation, it is desirable to automatically stop further compaction and permit the retraction of the ram to permit the user to withdraw the receptacle to redistribute the refuse therein to permit a more uniform distribution of the refuse in the receptacle whereupon a subsequent compaction operation may proceed without further undesirable tilting of the receptacle.

It is conventional to provide a manual control for effecting such a withdrawal of the ram upon the stopping of the compacting operation by the tilt switch. A problem arises, however, should the receptacle not only move sufficiently to open the tilt switch, but move somewhat further to open the receptacle safety switch. Under these conditions, power to the ram drive is interrupted and the user is therefore unable to retract the ram from the drawer.

A number of different devices have been provided in the prior art for controlling compacting drives. Thus, in U.S. Pat. No. 2,316,734 of Mansel S. Wells, a can crusher and baler is disclosed which is provided with an outlet closure having means for preventing the ram from being operated in the power stroke while the outlet closure is in an open position.

Victor F. Schuerman et al., in U.S. Pat. No. 3,805,084, show a compactor cycle control having safety interlock switches to assure that the machine can be operated only with the mechanism properly enclosed.

In U.S. Pat. No. 3,807,295 Einar O. Engebretsen discloses a compactor having an interlock automatically actuated by the initial downward movement of the ram to lock the receptacle in position beneath the ram.

Einar O. Engebretsen et al., in U.S. Pat. No. 3,808,453, show a compacting machine having a safety switch which prevents operation of the ram unless the door is closed and the receptacle is in the compacting position. The switch is bypassed once the ram enters the receptacle.

SUMMARY OF THE INVENTION

The present invention comprehends an improved refuse compactor structure having sequentially operable tilt and receptacle safety switches and means for preventing movement of the receptacle beyond the tilt switch operating position sufficiently to operate the receptacle safety switch during the compacting operation.

More specifically, the present invention comprehends the provision of means movable into the receptacle during the compacting operation which engages the receptacle to effectively limit displacement thereof beyond the tilt switch operating position during the compacting cycle.

In the illustrated embodiment, the receptacle movement limiting means comprises a stop means carried by the ram so as to be engageable by the receptacle when the receptacle moves sufficiently during the compacting operation to operate the tilt switch, but effectively limiting further movement of the receptacle so as to preclude operation of the receptacle safety switch.

In the illustrated embodiment, the stop means is removably secured to the ram and may comprise a rigid element extending rearwardly from the ram to adjacent the rear wall of the receptacle.

The ram may further be provided with a wiper which may comprise a flexible element having a portion interposed between the stop element and the receptacle wall during the compacting operation so as to define a portion of the displacement limiting means.

The control is arranged to permit the user to operate the ram in a retracting direction upon termination of the compacting operation by the tilt switch as a result of a tilted condition of the receptacle occurring during the compacting operation. Inasmuch as the movement limiting means of the present invention prevents undesirable movement during the compacting operation sufficiently to operate the receptacle safety switch, the problem of the prior art structures, as discussed above, is effectively eliminated in an extremely simple and economical manner.

Thus, the refuse compactor of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a phantom perspective view of a refuse compactor having control means embodying the invention;

FIG. 2 is a schematic electrical wiring diagram thereof;

FIG. 4 is a fragmentary enlarged side elevation illustrating in greater detail the receptacle position limiting means of the invention;

DESCRIPTION OF THE PREFERRED EMBODIMENT

Figure 3:
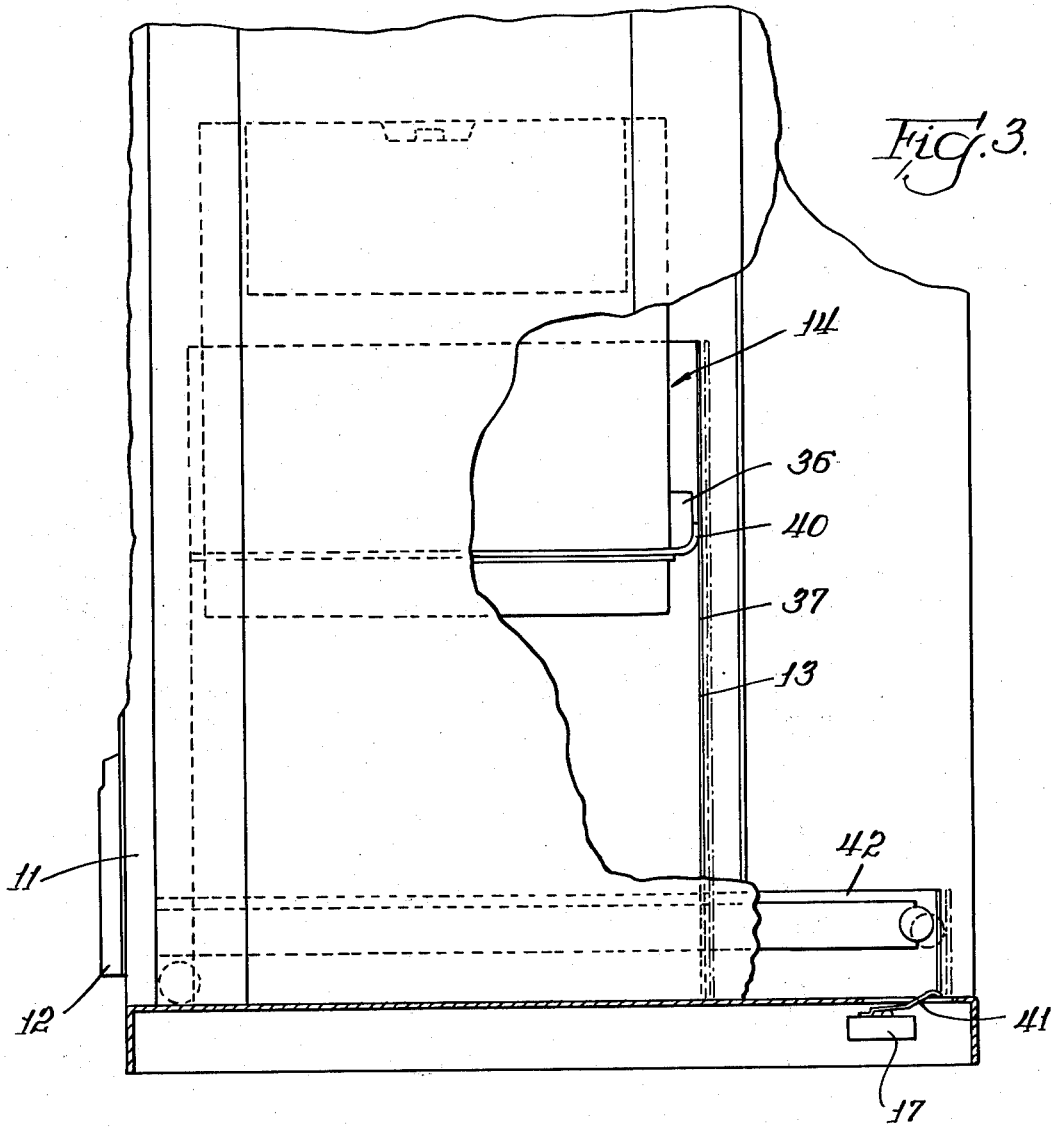
FIG. 3 is a fragmentary side elevation with portions broken away illustrating the provision of the improved receptacle movement control means of the invention.

In the exemplary embodiment of the invention as disclosed in the drawing, a refuse compactor generally designated 10 is shown to comprise a housing generally designated 11 having a front 12. A receptacle for holding refuse to be compacted comprises a drawer 13 which is selectively positionable in a compacting position within the cabinet, as shown in FIGS. 1 and 3, to permit a ram generally designated 14 to be urged forcibly down into the receptacle to compact refuse and the like placed therein.

The ram is moved downwardly into the receptacle in the compacting operation and reversely, upwardly from the receptacle in a retracting operation by suitable drive having an electric motor 15 which is controlled by a suitable electrical control system 16 illustrated in FIG. 2.

As illustrated in FIGS. 1 and 2, the control system includes a receptacle safety switch 17, a tilt switch 18, a start-stop switch 19, a top limit switch 20, and a directional switch 21. Motor 15 is provided with a start winding 22 having connected in series therewith a centrifugal switch 23 for disconnecting the start winding upon initiation of rotation of the motor. The motor further includes a run winding 24 and an overload protective device 25. As shown in FIG. 2, the control 16 may be energized from a suitable power source P, such as a conventional 120-volt alternating current power supply source.

As shown in FIG. 2, the start-stop switch 19 includes a normally open momentary contact pushbutton start switch 26, and a normally closed stop switch 27 connected in series between the receptacle safety switch and run winding 24 of motor 15. Tilt switch 18 and top switch 20 are connected in series from between the switches 26 and 27 to the run winding 24 of motor 15 and the directional switch 21. The directional switch may be thrown, in the conventional manner, from the forward arrangement of FIG. 2 to a reverse motor operating arrangement as the ram starts its downward motion so that when the centrifugal switch 23 closes as motor 15 slows due to an increase in the ram compacting pressure to above a preselected pressure the motor restarts in the reverse direction so as to effect an automatic retraction of the ram when the refuse in the drawer receptacle is compacted by the ram the desired amount.

The present invention is concerned with the problem that could arise if the receptacle safety switch 17 were to be opened as the result of a movement of the receptacle during the compacting operation, as under this condition, power would not be available to the motor 15 to effect a retraction of the ram, thus immobilizing the compactor apparatus. The present invention avoids this problem in a novel and simple manner by providing means for preventing movement of the receptacle sufficiently to open switch 17 during a compacting operation and permitting the movement of the receptacle sufficiently to open switch 17 only when the ram is in the retracted position, such as for exposing the receptacle to receive additional refuse.

More specifically, as shown in FIGS. 3 and 4, ram 14 is provided with a stop element 28 removably secured to the ram body 29 by removable securing means, such as screws 30 and 31. The ram body may comprise a U-shaped element having a side wall 32 and a bottom bight wall 33. The stop element may include a vertical flange 34 secured to the ram body side wall 29 by screw 30, and a horizontal bottom flange 35 secured to the ram body bight wall 33 by screw 31.

Figure 5:
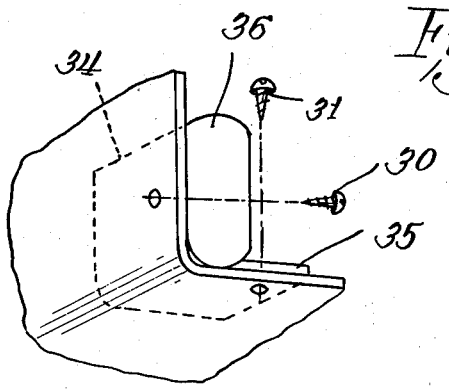
FIG. 5 is a fragmentary perspective view of the receptacle position limiting means.

As seen in FIGS. 4 and 5, the stop element further includes a rearwardly projecting nose portion 36 having a preselected rearward extension from the ram body 29 to be juxtaposed to the rear upright wall 37 of the drawer receptacle when the ram moves down into the receptacle during a compacting operation. As further illustrated in FIGS. 1 and 3, the ram includes a lowermost cover portion 38 and a horizontally projecting flexible wiper 39. During the downward movement of the ram, the wiper slidably engages the inner surface of the receptacle walls, and as shown in FIG. 5, is deflected upwardly by the downward movement so as to dispose a rear portion 40 thereof between the stop nose portion 36 and the receptacle rear wall 37.

In FIG. 3 the receptacle 13 is shown in solid lines engaging stop nose portion 36 with wiper portion 40 interposed. The receptacle safety switch 17 includes a switch operator 41. As can be seen in FIG. 3, the switch operator 41 still engages the receptacle track 42 when the receptacle wall portion 37 has engaged the stop nose portion 36 and wiper portion 40. Nominally an additional receptacle movement of approximately 0.35 inches would be required to move track 42 sufficiently to open switch 17 thereby deenergizing motor 15. Thus, the 0.35 inch dimension provides a safety factor in the event some part or parts are at the limits of their dimension tolerances by assuring switch 17 will not be opened.

Illustratively, receptacle 13 nominally must move approximately 0.5 inches open in order for tilt switch 18 to open deenergizing motor 15. The receptacle 13 nominally must move an additional 0.5 inches open in order for receptacle safety switch 17 to open preventing energization of the motor 15. Thus, in the nominal case once the receptacle moves 0.15 inches past the point where tilt switch 18 opens the rear wall 37 of the receptacle engages the stop nose portion 36 and wiper portion 40.

Thus, in the operation of the refuse compactor 10, displacement of the drawer receptacle sufficiently to open the receptacle safety switch 17 during a compacting operation is effectively precluded thereby avoiding the problem of immobilizing the motor 15 by an undesirable movement of the receptacle by the ram during the compacting operation is effectively eliminated. The stop means is extremely simple and economical of construction while yet providing the improved movement limiting functioning discussed above.

The foregoing disclosure of specific embodiments is illustrative of the broad inventive concepts comprehended by the invention.

Having described the invention, the embodiments of the invention in which an exclusive property or privilege is claimed are defined as follows:

1. In a refuse compactor having a receptacle for holding refuse to be compacted, electrically operated compacting means for compacting refuse in the receptacle with the receptacle disposed in a compacting position, first switch means for interrupting operation of the compacting means in the event the receptacle is displaced a first preselected distance from the compacting position by the compacting means during a refuse compacting operation, and second switch means for preventing operation of the compacting means in the event the receptacle is disposed at least a second preselected distance greater than said first distance from the compacting position, the improvement comprising stop means carried by said compacting means to be disposed adjacent the receptacle during a compacting operation permitting the receptacle to be displaced said first preselected distance but preventing displacement of the receptacle said second preselected distance from said compacting position.

2. The refuse compactor of claim 1 wherein said stop means is positioned within said receptacle during the compacting operation.

3. The refuse compactor of claim 1 wherein said compacting means include a ram provided with a flexible wiper for wiping the receptacle during the compacting operation, said wiper defining a portion of said stop means.

4. The refuse compactor of claim 1 wherein said stop means comprises a rigid element carried by the compacting means .

5. The refuse compactor of claim 1 wherein said stop means comprises a rigid element carried by the compacting means and a flexible element carried by the compacting means and extending between the rigid element and the receptacle during the compacting operation.

6. The refuse compactor of claim 1 wherein removable securing means are provided for removably securing said stop means to said compacting means.

7. The refuse compactor of claim 1 further including manually controlled switch means for retracting the compacting means from the receptacle in the event the receptacle is displaced sufficiently during a compacting operation to operate said first switch means.

8. The refuse compactor of claim 1 wherein said compacting means includes a ram and said stop means is carried by said ram.

9. In a refuse compactor having a support, a ram, a receptacle into which refuse is placed to be compacted, said receptacle being movably carried on said support for selective disposition in a refuse compacting position in alignment with the ram and in an exposed refuse loading position, electrically operable drive means for selectively driving the ram into the receptacle to effect a compacting operation, and control means for controlling operation of the drive means including a tilt switch, a receptacle safety switch and a manually operable start switch, said tilt switch being positioned to open upon a preselected first small displacement of the receptacle from said compacting position, said receptacle safety switch being positioned to open upon a preselected second displacement of the receptacle from said compacting position greater than said first small displacement, said start switch being connected to the drive means to permit re-energization of the drive means subsequent to a stopping of the drive means as a result of said receptacle being displaced at least said first displacement from said compacting position during the compacting operation, the improvement comprising means carried by said ram permitting said receptacle to be displaced at least said first small displacement run said compacting position but preventing said receptacle from being displaced said second displacement from said compacting position while said ram is positioned in said receptacle during a compacting operation.

10. The refuse compactor of claim 9 wherein said means carried by the ram defines abutment means received within the receptacle during the compacting operation.

11. The refuse compactor of claim 9 wherein said means carried by the ram defines abutment means and said ram is provided with a flexible wiper having a portion comprising a portion of said abutment means.

* * * * *